US005289747A

United States Patent [19]

Wunderlich

[11] Patent Number: 5,289,747

[45] Date of Patent: Mar. 1, 1994

[54] VARIABLE VELOCITY CONVEYING METHOD AND APPARATUS FOR CONTINUOUS MOTION SAWS

[75] Inventor: Gary R. Wunderlich, Green Bay, Wis.

[73] Assignee: Paper Converting Machine Company, Green Bay, Wis.

[21] Appl. No.: 13,636

[22] Filed: Feb. 4, 1993

[51] Int. Cl.[5] ..... B26D 1/60; B26D 5/20

[52] U.S. Cl. ..... 83/38; 83/54; 83/313; 83/329

[58] Field of Search ..... 83/13, 37, 38, 54, 312, 83/313, 329, 330

[56] References Cited

U.S. PATENT DOCUMENTS

| | | | |
|---|---|---|---|
| Re. 30,598 | 5/1981 | Spencer | 83/14 |
| 3,886,830 | 6/1975 | Holthoff et al. | 83/329 |
| 4,370,140 | 1/1983 | Fegley et al. | 83/329 |
| 4,688,455 | 8/1987 | Takehara | 83/329 |

*Primary Examiner*—Hien H. Phan

*Attorney, Agent, or Firm*—Tilton, Fallon, Lungmus & Chestnut

[57] ABSTRACT

A method and apparatus for the operation of a skewed orbiting saw which is employed for transversely cutting continuously advancing elongated lengths of multi-ply material into shorter lengths, the means for varying the speed of advance of the lengths of material.

4 Claims, 2 Drawing Sheets

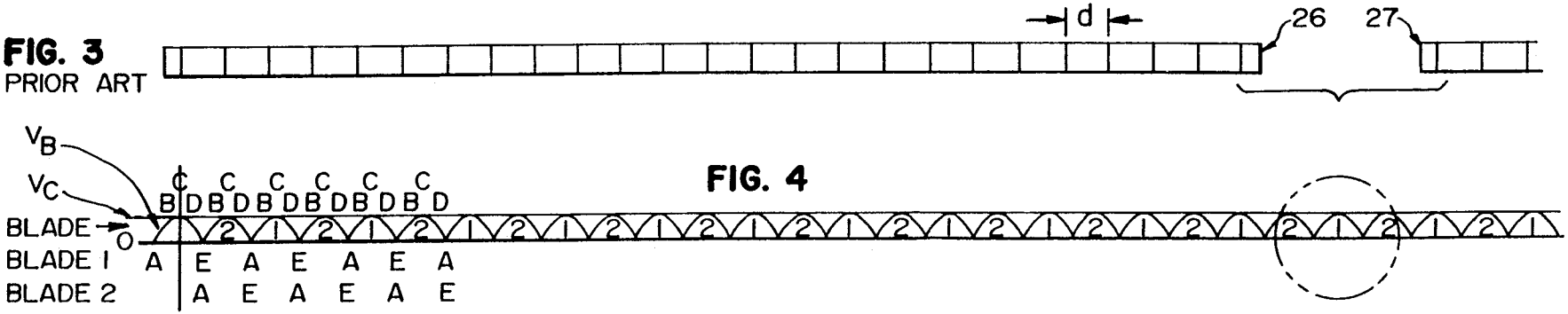
FIG. 3
PRIOR ART
FIG. 4
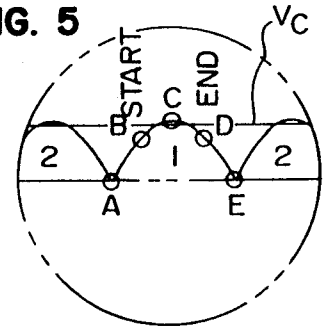
FIG. 5
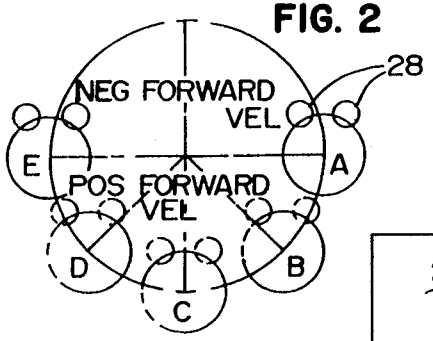
FIG. 2
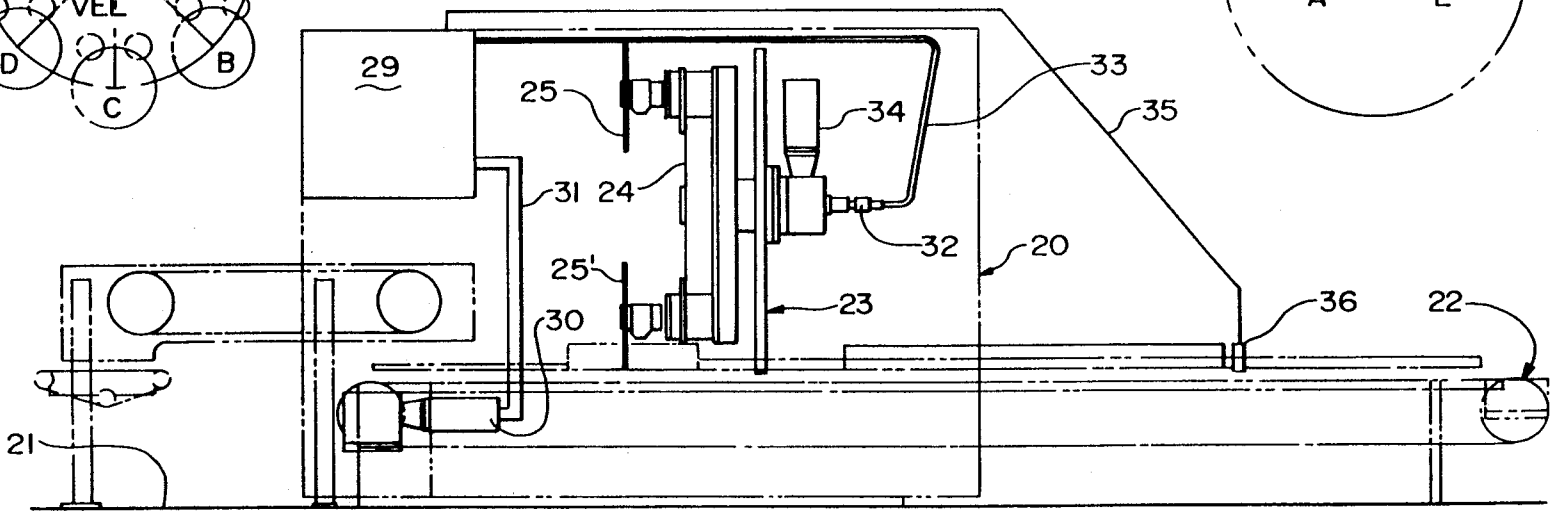
FIG. 1

$V_B$
$V_C$
BLADE 0
BLADE 1
BLADE 2
$d_L$
26
27
START
END

VARIABLE VELOCITY CONVEYING METHOD AND APPARATUS FOR CONTINUOUS MOTION SAWS

BACKGROUND AND SUMMARY OF INVENTION

This invention relates to a variable velocity conveying method and apparatus for continuous motion saws and, more particularly to a skewed orbiting saw for transversely cutting continuously advancing elongated lengths of multi-ply material into shorter lengths.

This invention is an improvement on co-owned Patent RE 30,598 and reference may be had thereto for details of construction and operation not set forth herein. The '598 patent employed a saw moving through an orbit which was skewed to the direction of movement of the multi-ply material. One advantageous application has to with "logs" of convolutely wound paper such as are used for kitchen toweling and toilet tissue. In the manufacture of such household products, a web is unwound from a parent roll of five to nine feet in diameter and eight to eleven feet in axial length, transversely perforated and then rewound into a "log" having the diameter of the retail size roll. Thereafter, the elongated log is transversely severed into axial lengths corresponding to those found on the store shelves. This transverse cutting has been advantageously performed in the past by means of orbiting log saws. Also such orbiting log saws have been employed to separate elongated stacks of interleaved web material such as facial tissues and toweling. The above-identified '598 patent represented a major breakthrough because prior to the skewed orbit saw, the saw operation had to be limited while the log was indexed past the saw for the next cutting position. By using the skewed orbit, the log could be advanced continuously because the saw traveled with the log during the cutting operation. The producers of wound superimposed plies such as toilet tissue and toweling logs and stacked superimposed plies such as folded tissue and toweling are continually demanding increased efficiency which includes reduced down-time for maintenance such as that to correct infeed product conveyor chain wear and also for product changeover such as various cutoff lengths. These problems have not been solved by the current state of the art and the invention herein described does solve these problems.

For example, as the infeed product conveyor chain wears, the velocity profile can be altered by pushbutton to compensate for it. As the cutoff requirements change based on various product or marketing demands, the velocity profile of the infeed product conveyor can be changed by pushbutton. An added advantage to the non-uniformly advancing of material is the ability to reduce or eliminate the cut error produced by the mismatch in velocity between the infeed product conveyor and the disc blade when uniformly advancing the infeed product conveyor. By eliminating this mismatch, a higher quality square cut is achieved.

The inventive saw uses the same skewed orbit axis as the '598 patent but provides a means for accelerating and decelerating the log during the short time period of the cutting cycle. Where the speed variation is between cuts, the roll cut length can be varied from the nominal, constant speed case. Even further, the means for accelerating and decelerating can be used to match the blade motion at the log. More particularly, variation of the inventive concept is where the log speed is non-uniform during cutting to match the actual, (sinusoidal) motion of the saw. According to the invention, a drive such as a servo motor is provided to vary the velocity of the product conveyor system on a continuous motion saw for achieving the objectives, i.e., solutions to problems, set forth above. Thus, in particular, the invention provides a means and method for correcting for chain wear. It provides a means and method for quick change of cutoff length and it provides a means and method for eliminating theoretical cut error due to mismatch in velocity between the blade and product during cutting.

Other objects and advantages of the invention may be seen in the details of construction and operation set down in the ensuing specification.

BRIEF DESCRIPTION OF DRAWINGS

The invention is explained in conjunction with the accompanying drawings in which FIG. 1 is a side elevational view (somewhat schematic) of a log saw system based upon the prior art but incorporating certain features of the invention;

FIGS. 2–5 are all representative of the prior art, FIG. 2 being a schematic diagram of the path of blades which are described further in FIGS. 3–5;

FIG. 3 is a schematic representation of a series of cut rolls from an elongated log;

FIG. 4 is a chart of blade movement to achieve the cuts represented in FIG. 3 and in terms of the positions designated in FIG. 2;

FIG. 5 is an enlargement of the encircled portion at the right hand end of FIG. 4;

DETAILED DESCRIPTION

Figures 6, 7, 8, 9, 10, 11, 12:
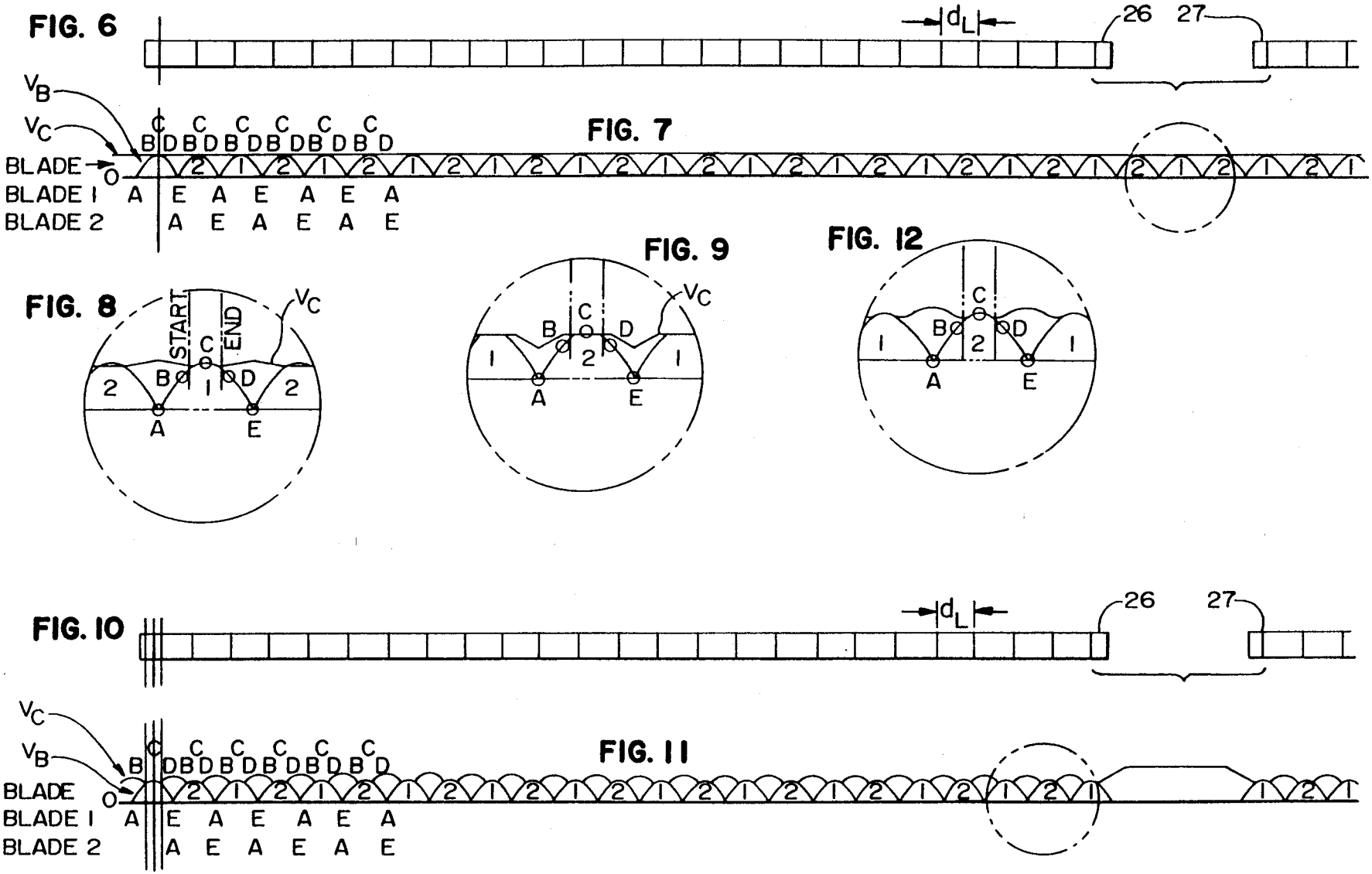
FIG. 6 is a view similar to FIG. 3 but in which the invention is employed to provide a non-uniform log velocity by virtue of acceleration/deceleration between cut intervals.
FIG. 7 is a view similar to FIG. 4 and correlates the movement of the log to the cuts illustrated in FIG. 6.
FIG. 8 is a view similar to FIG. 5 but showing the acceleration/deceleration characteristic of the invention and being an enlarged version of the encircled version of FIG. 7.
FIG. 9 is a view similar to FIG. 8 but showing a deceleration/acceleration movement of the log between cuts whereby the cut roll length is shortened—as contrasted to being lengthened as is the case with the showing in FIGS. 6–8.
FIG. 10 is a view similar to FIGS. 3 and 6 but showing the effect of blade correction at the log.
FIG. 11 is a view similar to FIGS. 4 and 7 and relating to the showing of the log movement (sinusoidal) which is further illustrated in FIG. 12.
FIG. 12 is an enlarged view of the encircled portion of FIG. 11.

Referring first to FIG. 1, the numeral 20 designates generally the frame of the log saw. This frame is advantageously supported on the floor 21 of a converting plant—as is the log conveyor generally designated 22. The conveyor 22 is seen to be advancing a log L past an orbiting saw generally designated 23. The principal feature of the saw is an orbit head 24 which carries a pair of saw blades or discs 25, 25'. The operation of the structure described thus far is precisely that set forth in the above identified '598 patent and express reference is hereby made thereto for details of construction and operation not set forth herein.

Prior Art Operation

The prior art operation is summarized in FIGS. 2–5. The significant thing to note is shown in FIG. 5 wherein the numeral $V_c$ designates the velocity profile of the log conveyor 22. It is a straight line and thus the velocity is constant throughout the operation. This same constant velocity is reflected at $V_c$ in FIG. 4 and has been used to advantage over the years to produce retail size rolls of an axial dimension d of 4.125", for example. This is designated in FIG. 3 where the showing is of a log which has been produced on a 100" wide machine. This yields 24 individual rolls of 4.125" axial length d with ½" trim annuli 26, 27 at each end—see the upper right hand portion of FIG. 3. This is achieved by the blades 25, 25' which act in sequence on the log, being designated Blade 1 and Blade 2 in FIG. 4. Each blade goes through a cycle designated A–C. For example, the saw 25' of FIG. 1 is in the "C" position of FIG. 2. The additional small circles as at 28 in the showing in FIG. 2 represent sharpening stones for the disc blades 25, 25' which are not shown in FIG. 1 but are conventional in this art.

Referring again to FIG. 4, the symbol $V_c$ refers to the velocity of the conveyor which, as referred to in FIG. 5 is constant. On the other hand, the velocity ($V_B$) of the saw blade in the direction of product travel has a sinusoidal path or profile. As the saw proceeds clockwise downwardly as seen in FIG. 2 there is a forward velocity between points A and E but a negative or rearward velocity between points E and A.

Lastly relative to the prior art, it will be noted in FIG. 5 that there is a relatively short portion of the path of the disc saw blade wherein cutting occurs—this being at the top of the sinusoidal curve between "START" and "END".

To achieve the benefits of the invention, a servo controller and amplifier 29 is provided—advantageously on the frame 20 associated with the log saw. This is connected to the servo motor 30 by lines 31 and to the master encoder 32 by the line 33. The numeral 34 in the upper central part of FIG. 1 designates the orbit head motor.

The servo controller 29 is also connected by line 35 to a flight conveyor home position detector 36. In normal operation the detector 36 is used only on start up after power has been cut off from the servo motors. What the controller and servo motors do is to vary the speed of the conveyor from the linear or constant profile depicted in FIG. 5.

The Inventive Embodiment of FIGS. 6–8

In FIG. 6, there are illustrated 22 retail size rolls each having a dimension $d_L$ which advantageously may be 4.500". Twenty-two of such rolls yields 99" total usable length again with the trim at each end again being designated 26, 27. The difference here can be readily appreciated from a comparison of FIG. 8 with FIG. 5. In FIG. 8 the velocity profile $V_C$ shows first an acceleration and then a deceleration between cuts. This then permits larger length rolls as has been depicted in FIG. 6 at $d_L$. The servo controller 29 makes this change possible merely by operating a push-button to set the axial length at the desired value. Such as controller is commercially available from Giddings & Lewis Company located in Fondulac, Wis. under Model No. PIC-900.

In similar fashion, the invention provides means for shortening the roll lengths of FIG. 2. This is illustrated by the showing in FIG. 9 where first there is a deceleration followed by an acceleration in the speed $V_C$ of the conveyor between saw cuts.

Embodiment of FIGS. 10–12

As pointed out previously, it is possible according to the invention, to match the conveyor speed to the blade speed during cutoff and also to speed up or slow down the conveyor between cuts. For illustration, the showing in FIG. 10 is again of a product axial length $d_L$ of 4.500" with the usual trim 26 and 27. What is different between the embodiment of FIGS. 10–12 and that of FIGS. 6–9 is that the speed of the conveyor $V_C$ during the cut matches the sinusoidal saw motion as can be readily appreciated from the portion C of FIG. 12.

While in the foregoing specification a detailed description of an embodiment of the invention has been set down for the purpose of illustration, many variations in the details hereingiven may be made by those skilled in the art without departing from the spirit and scope of the invention.

I claim:

1. In the method of operating a skewed orbiting saw for transversely cutting continuously advancing elongated lengths of multi-ply web material into shorter lengths, said saw having a substantially constant speed component parallel to said elongated lengths during cutting: advancing said elongated lengths at a speed substantially equal to said saw speed component during cutting and varying the speed of advance of said elongated lengths between consecutive cuttings from said substantially equal speed by accelerating/decelerating said elongated lengths while maintaining said saw at said substantially constant speed.

2. The method of claim 1 in which said varying step include the use of servo means to achieve a predetermined profile of speed advance of said elongated lengths.

3. The method of claim 1 in which the saw speed component during cutting and the speed of advance of said elongated length during cutting are the same.

4. Apparatus for transversely cutting continuously advancing elongated lengths of multi-ply material into shorter lengths comprising a frame, conveyor means on said frame for advancing said elongated lengths along a linear path, a saw mounted on said frame for movement through an orbit skewed with respect to said path, said saw having a substantially constant speed component parallel to said linear path during cutting, control means operably associated with said conveyor means for advancing said elongated lengths at a speed substantially equal to said saw speed component during cutting and for varying the speed of advance of said elongated lengths between consecutive cuttings from said substantially equal speed by accelerating/decelerating said elongated lengths.

* * * * *